US008539679B2

(12) United States Patent
Caswell

(10) Patent No.: US 8,539,679 B2
(45) Date of Patent: Sep. 24, 2013

(54) DUAL DISK PIZZA CUTTER AND METHODS

(76) Inventor: Ty Caswell, Zimmerman, MN (US)

( * ) Notice: Subject to any disclaimer, the term of this patent is extended or adjusted under 35 U.S.C. 154(b) by 358 days.

(21) Appl. No.: 12/813,356

(22) Filed: Jun. 10, 2010

(65) Prior Publication Data

US 2010/0313432 A1 Dec. 16, 2010

Related U.S. Application Data

(60) Provisional application No. 61/186,769, filed on Jun. 12, 2009.

(51) Int. Cl.
*B26D 1/157* (2006.01)
*B26D 3/24* (2006.01)

(52) U.S. Cl.
USPC ..... 30/307; 30/265; 30/365

(58) Field of Classification Search
USPC ..... 30/263, 265, 287, 292, 294, 299, 30/301, 304, 306, 307, 319, 365; D7/694
See application file for complete search history.

(56) References Cited

U.S. PATENT DOCUMENTS

| | | | | | |
|---|---|---|---|---|---|
| 976,496 | A | * | 11/1910 | Reiser | 30/365 |
| 1,720,305 | A | * | 7/1929 | Tjernlund | 30/265 |
| 1,916,725 | A | * | 7/1933 | Harbour et al. | 172/15 |
| 3,111,914 | A | * | 11/1963 | Viviano | 425/289 |
| 3,710,444 | A | * | 1/1973 | Fishman | 30/265 |
| 4,502,223 | A | * | 3/1985 | Brookfield | 30/365 |
| 4,809,437 | A | * | 3/1989 | Saliaris | 30/319 |
| 6,163,966 | A | * | 12/2000 | Jackson et al. | 30/365 |
| D511,075 | S | * | 11/2005 | Christ et al. | D7/694 |
| 2003/0233756 | A1 | * | 12/2003 | Muhlebach | 30/265 |
| 2012/0096719 | A1 | * | 4/2012 | Zdroik et al. | 30/124 |

* cited by examiner

*Primary Examiner* — Hwei C Payer
(74) *Attorney, Agent, or Firm* — Holland & Hart LLP

(57) ABSTRACT

A pizza cutter that includes a handle, a cutting member support, and first and second disk members. The handle is configured for grasping by a user. The cutting member support extends from the handle. The first disk member is supported on the cutting member support. The second disk member is supported on the cutting member support. The first and second disk members may be arranged non-parallel relative to each other.

14 Claims, 8 Drawing Sheets

DUAL DISK PIZZA CUTTER AND METHODS

CROSS REFERENCE TO RELATED APPLICATIONS

This application claims the benefit of the filing date of U.S. Provisional Application No. 61/186,769, filed Jun. 12, 2009, and entitled DUAL DISK PIZZA CUTTER AND METHODS, the disclosure of which is incorporated, in its entirety, by reference.

TECHNICAL FIELD

The present disclosure generally relates to cutting devices, and more particularly relates to cutting devices with disk cutting members.

BACKGROUND

Cutting devices that include a single cutting member, such as a cutting disk, are well-known in the art. A single disk cutting device typically includes a handle, a cutting member support, and a disk supported on the cutting member support. The disk is rotatably mounted to the cutting member support. In at least one application, the cutting device is a pizza cutter adapted to cut a cooked pizza. The cooked pizza on a flat, typically horizontal surface. A downward force is applied to the cutting device by the user (typically via the handle) to at least partially penetrates the cooked pizza with the disk. The user then applies a horizontally directed force while the disk maintains contact with the cooked pizza. The horizontal force tends to push the disk through the cooked pizza thereby at least partially cutting the pizza. Several back and forth cutting motions with the cutting device are typically required in order to completely cut through the toppings (e.g., cheese, meat and vegetables) and crust of the pizza.

An opportunity exists for improving cutting devices such as food cutting devices, in particular pizza cutting devices.

SUMMARY

One aspect of the present disclosure relates to a cutting device that includes a handle portion, a support member extending from the handle portion, and first and second cutting members. The first and second cutting members are mounted to the support member. The first cutting member defines a first cutting surface and the second cutting member defines a second cutting surface. A first portion of the first cutting surface is arranged adjacent to a first portion of the second cutting surface. A second portion of the first cutting surface is arranged spaced apart from a second portion of the second cutting surface. The first and second cutting members may be arranged non-parallel relative to each other.

Another aspect of the present disclosure relates to a cutting device that includes first and second disk shaped cutting members. The first disk shaped cutting member defines a first cutting surface around a periphery thereof. The second disk shaped cutting member defines a second cutting surface around a periphery thereof. The first and second disk cutting member are arranged at a compound angle relative to each other.

A further aspect of the present disclosure relates to a method of cutting an item. The method includes providing a cutting device having first and second disk cutting members, wherein the first and second cutting members are arranged at least one converging angle relative to each other. The method may also include arranging the item in a horizontal plane, applying a vertically downward force on the cutting device to at least partially penetrate the item with the first and second disk cutting members, and applying a horizontal force to the cutting device to move the cutting device in a horizontal direction. The first and second disk cutting members may both cut the item and separate cut portions of the item as the cutting device moves in the horizontal direction.

A further aspect of the present disclosure relates to a pizza cutter that includes a handle, a cutting member support, and first and second disk members. The handle is configured for grasping by a user. The cutting member support extends from the handle. The first disk member is supported on the cutting member support. The second disk member is supported on the cutting member support. The first and second disk members may be arranged non-parallel relative to each other.

The above summary of the present invention is not intended to describe each embodiment or every implementation of the present invention. The Figures and the detailed description that follow more particularly exemplify a preferred embodiment.

DETAILED DESCRIPTION

Figure 1:
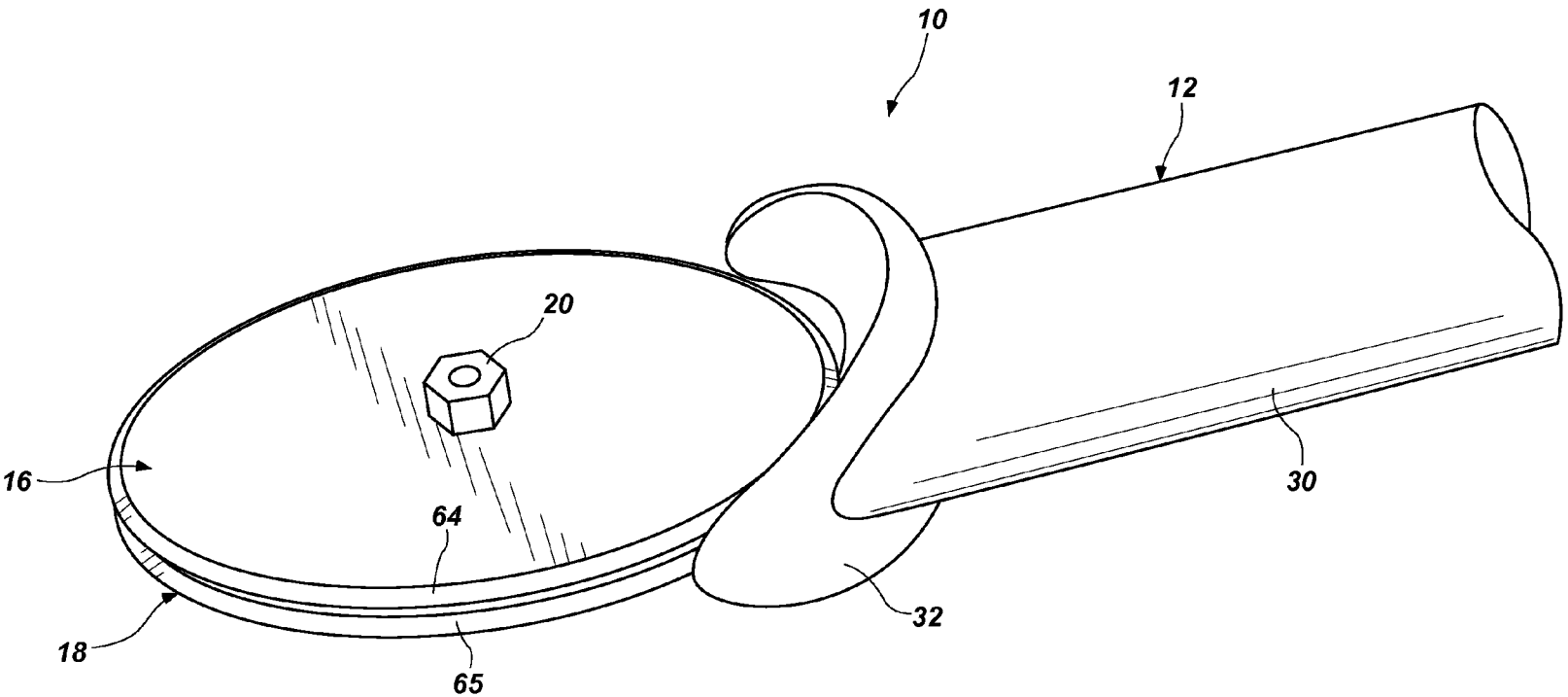
FIG. 1 is a schematic bottom perspective view of an example cutting device in accordance with principles of the present disclosure.
Figure 2:
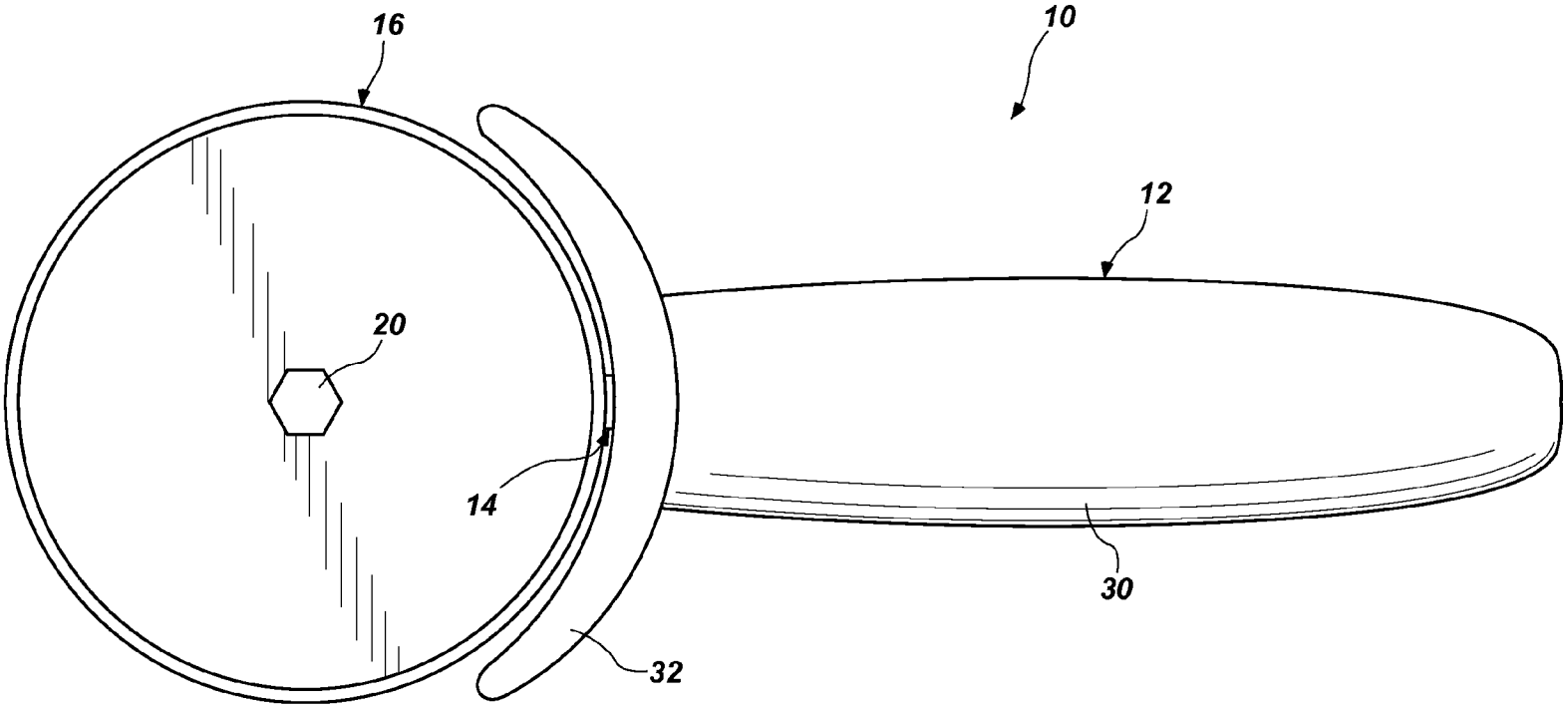
FIG. 2 is a schematic side view of the cutting device of FIG. 1.

The present disclosure generally relates to cutting devices. The present disclosure more particularly relates to food cutting devices. One application of the cutting devices disclosed herein is a pizza cutting device that includes at least one disk-shaped cutting member. In one example, the cutting device includes two disk-shaped cutting members arranged side-by-side. The two disk members may be identical in shape and size. The two disk members may be arranged at non-parallel angles relative to each other. The disk members may be arranged at least one converging angle relative to each other. In one example, the first and second disk members of the cutting device are arranged at a compound angle relative to each other. The compound angle may include a first angle relative to a first plane, and a second angle relative to a second plane, wherein the first and second planes are arranged perpendicular to each other.

The angled relationship between the disk members of the cutting device may provide some improvement in cutting an item, such as a cooked pizza. The angled relationship between the cutting members of the cutting device may provide some separation of the cut portions of the item during use of the cutting device. In at least some arrangements, the angled relationship between the cutting members of the cutting device may provide concurrent cutting of an item and separation of the cut portions of the item. In other arrangements, the angled relationship between the cutting members of the cutting device may provide cutting of an item followed by at least partial separation of the cut portions of the item. Providing a cutting device with two or more cutting members arranged side-by-side may provide multiple cutting surfaces that concurrently cut an item. The cutting surfaces of the multiple cutting members of the cutting device may converge at a single location around a periphery of the cutting members to provide cutting of the item at a single cutting point that includes a cutting surface of each cutting member.

While the example cutting devices discussed hereinafter with reference to the figures are directed primarily to a cutting device particularly suited for cutting pizza, the principles disclosed herein may be applied to other types of cutting devices intended for use in cutting other items, such as cloth, paper, and other types of food items. Furthermore, while the illustrated examples include a single pair of cutting disks, many other configurations of cutting members are possible including, for example, three or more cutting members arranged side-by-side, multiple cutting members arranged in series such as, for example, two pairs of disk-shaped cutting members arranged in series, or a combination of disk-shaped cutting members with other shaped cutting members. Furthermore, while the cutting members illustrated in the attached figures include a relatively smooth cutting surface (i.e., a smooth peripheral cutting edge of a disk), other cutting surface are possible such as, for example, serrated, S-shaped, or other shapes.

Furthermore, the cutting devices disclosed herein may include additional features specific to the type of item being cut with the cutting device. In one example, the cutting device is suited for use cutting a food item, such as pizza, and the cutting device includes a cleaning or scraping type feature that is applied to one or more surfaces of at least one of the cutting members of the cutting device to remove food that collects on the cutting member.

Referring now to FIGS. 1-7, an example cutting device 10 is shown and described. The cutting device 10 includes a handle 12, a cutting support 14, and first and second cutting members 16, 18. The cutting member support 14 extends from the handle 12. The first and second cutting members 16, 18 are carried by the cutting member support 14. The first and second cutting members 16, 18 are arranged generally side-by-side. The first and second cutting members 16, 18 have disk-shaped constructions.

The handle 12 includes a grip portion 30 and a flange portion 32. The grip portion 30 is configured for grasping by a user's hand. The flange portion 32 is positioned between the grip portion 30 and the first and second cutting members 16, 18. The flange portion 32 may provide a stop surface that limits forward movement of the user's hand along the grip portion. The flange portion 32 may provide some physical separation between the grip portion 30 and the first and second cutting members 16, 18 and may provide some safety for the user.

Figure 3:
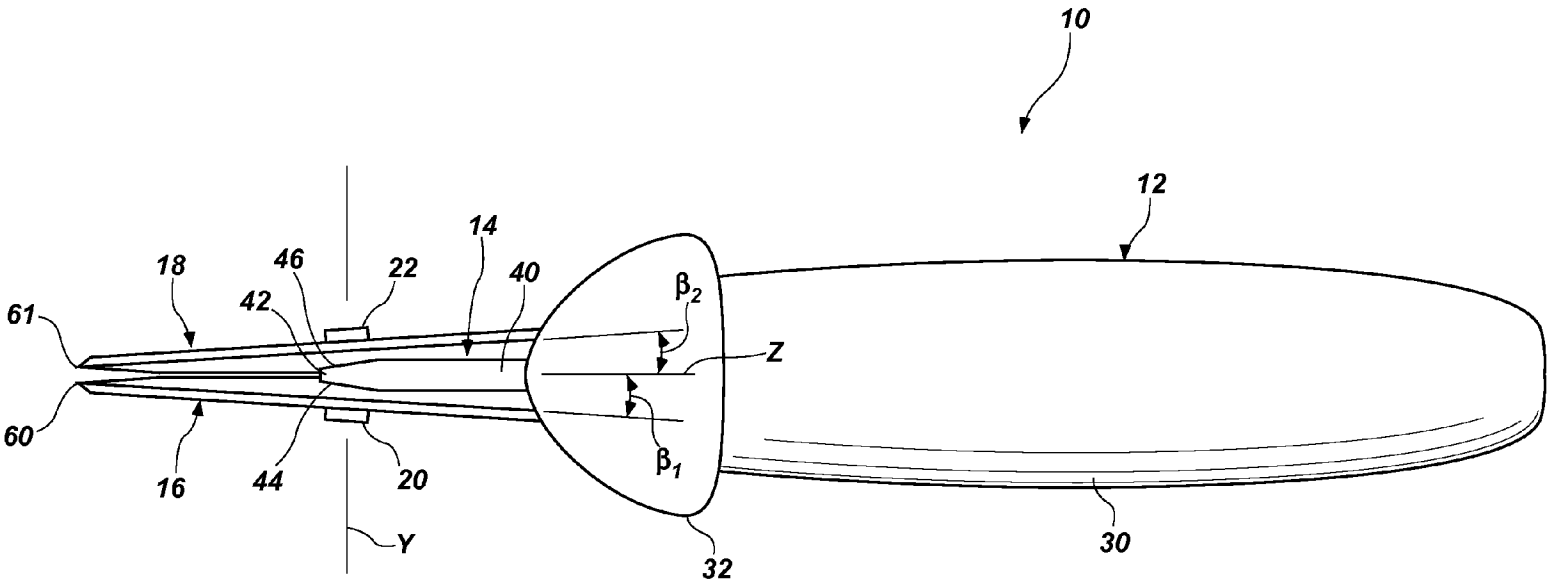
FIG. 3 is a schematic top view of the cutting device of FIG. 1.

The cutting member support 14 includes a proximal end portion 40, a distal end portion 42, first and second mounting surfaces 44, 46 (see FIG. 3). The cutting member support 14 is mounted to the handle 12 at the proximal end portion 40. The first and second cutting members 16, 18 are mounted to the cutting member support 14 at the distal end portion 42.

The first mounting surface 44 provides a surface against which the first cutting member 16 is supported in a lateral or axial (i.e., an axis about which the first cutting member 16 rotates) direction. The second mounting surface 46 provides a surface against which the second cutting member 18 is supported in a lateral or axial (i.e., an axis about which the second cutting member 18 rotates) direction. The orientation of the first and second mounting surfaces 44, 46 may determine, at least in part, the orientation of the first and second cutting members 16, 18, respectively, relative to the cutting member support 14 and handle 12. The orientation of the first and second mounting surfaces 44, 46 may also determine, at least in part, a relative angled orientation between the first and second cutting members 16, 18.

The first and second mounting surfaces 44, 46 may include an aperture sized to receive an axle member that is mounted to the cutting member support 14. Axle members extending from the first and second mounting surfaces 44, 46 may provide a bearing surface about which the first and second cutting members 16, 18 rotate. Axle members extending from each of the first and second mounting surfaces 44, 46 may be arranged perpendicular to the first and second mounting surfaces 44, 46, respectively. This perpendicular arrangement of the axle members (e.g., see FIGS. 5 and 6) may help the first and second cutting members 16, 18 rotate in planes parallel to the first and second mounting surfaces 44, 46, respectively.

The first and second axle members 48, 50 may be constructed as, for example, bolts having a head and a shank, wherein the shank includes plurality of threads along an external surface thereof. The first and second cutting members 16, 18 may each include an axle aperture at, for example, a center point thereof. The first and second cutting members 16, 18 may be mounted to the first and second axle members 48, 50 via the axle apertures (not shown). First and second retainer members 20, 22 may be secured to the first and second axle members 48, 50 after the first and second cutting members 16, 18 are mounted to the first and second axle members 48, 50. The first and second retainer members 20, 22 may be configured to retain the first and second cutting members 16, 18 on the first and second axle members 48, 50. In some arrangements, the first and second axle members 48, 50 are integral with the first and second retainer members 20, 22 as a screw, rivet, or other type of unitary fastener. Many other fastener and connection devices may be used to mount the first and second cutting members 16, 18 to the cutting member support 14. The use of screws, bolts, or other adjustable fasteners may provide for easy removal of the first and second cutting members 16, 18 for purposes of, for example, cleaning or repair of the cutting device 10.

Figure 4:
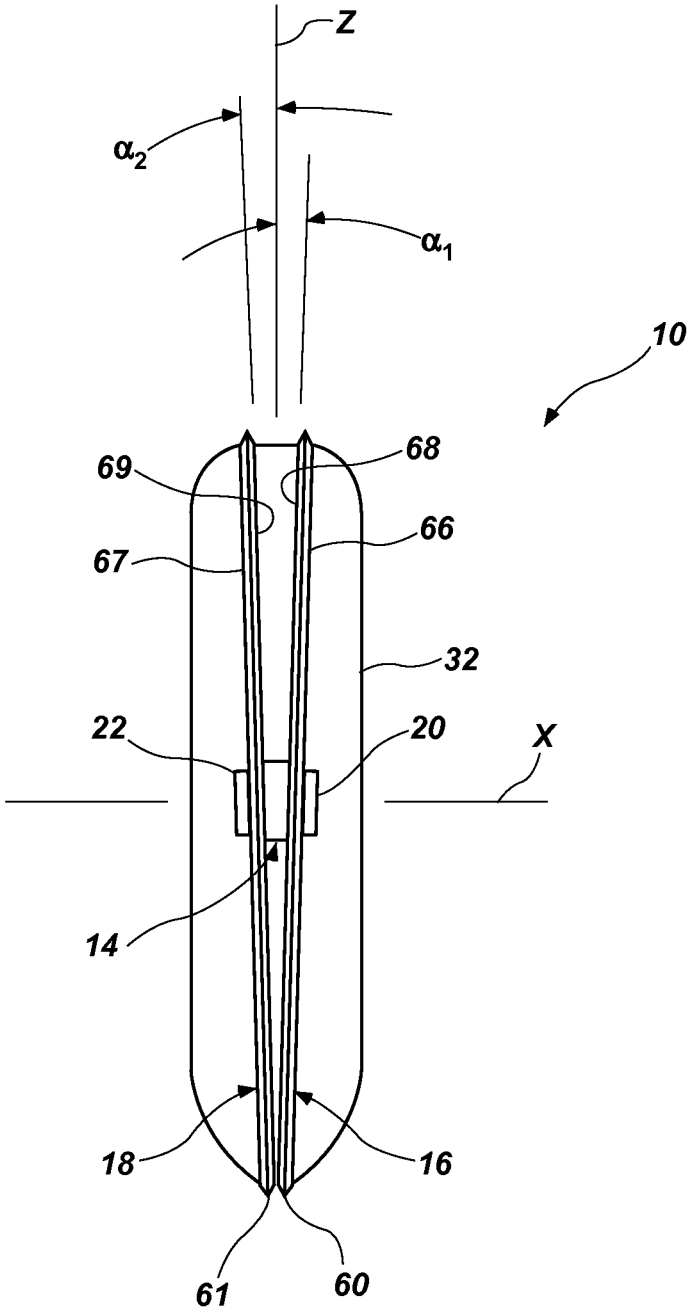
FIG. 4 is a schematic front view of the cutting device of FIG. 1.

The first cutting member 16 includes a cutting surface 60 arranged around a periphery 64, and opposing side surfaces 66, 68 (see FIG. 4). The second cutting member 18 includes a cutting surface 61 arranged around a periphery 65, and opposing side surfaces 67, 69 (see FIG. 4). As noted above, the first and second cutting members 16, 18 may each include an axle aperture (not shown) arranged centrally that extends between the opposing side surfaces 66, 68 and is sized to receive an axle about which the first and second cutting members 16, 18 rotate.

The cutting surfaces 60, 61 may be defined by tapering one of the side surfaces 66-69 adjacent to the periphery 64, 65. In some arrangements, a taper is included on each of the opposing side surfaces 66, 68 and 67, 69 at the periphery 64, 65 to define the cutting surfaces 60, 61. In some arrangements, a thickness of the first and second cutting members 16, 18 defined between the opposing side surfaces 66, 68 and 67, 69 is by itself sufficiently thin to define a cutting surface without the need for adding a taper near the periphery 64, 65.

The first and second cutting members 16, 18 may be arranged at least one converging angle relative to each other. Referring to FIG. 3, the first and second cutting members 16, 18 are shown converging toward each other at angles $\beta_1$, $\beta_2$ relative to the Z plane within the X plane (see FIG. 4). The first and second cutting members 16, 18 may also be arranged at converging angles relative to each other within a second plane as shown in FIG. 4. FIG. 4 illustrates the first and second cutting members 16, 18 converging toward each other at angles $\alpha_1$, $\alpha_2$ relative to the Z plane within the Y plane (see FIG. 3). The angled relationship between the first and second cutting members 16, 18 provides a non-parallel relative orientation between the first and second cutting members 16, 18. This non-parallel orientation may be defined as a compound angle. The compound angle may be defined by the angles $\beta_1$, $\beta_2$ and $\alpha_1$, $\alpha_2$ in which the first and second cutting members 16, 18 are arranged at converging angles within both the X and Y planes relative to the Z plane.

Arranging the first and second cutting members 16, 18 at a non-parallel arrangement, and in particular at a compound angle arrangement may provide certain advantages. One advantage may relate to the use of two cutting members 16, 18 arranged side-by-side with cutting surfaces 60, 61 positioned adjacent to each other at least one location (see FIG. 4). This arrangement of adjacent cutting surfaces provides two cutting points for the cutting device 10 when cutting an item. The cutting surfaces may be positioned sufficiently close together that when cutting some items such as, for example, a cooked pizza or other food items, the cutting surfaces 60, 61 effectively act as a single point of cutting effectuated by two separate cutting surfaces. The use of two cutting surfaces may improve penetration through the item to be cut in a vertical direction and maintaining such penetration while forward advancing the cutting device through the item.

Another advantage related to the arrangement shown in FIGS. 1-7 that relates to the compound angled arrangement of the first and second cutting members 16, 18 is that the cutting members 16, 18 diverge from each other in the rearward direction towards the handle 12. Such a diverging, angled relationship tends to provide a wedge structure that assists in separating those portions of the item that have been cut. This separating action may be particularly useful when cutting food items, such as pizza, wherein the food item has multiple layers with each layer having a different physical property (i.e., melted cheese, meat, sauce, and crust). The separating action of the diverging first and second cutting members 16, 18 may help separate the layers of the food item just following the cutting action provided by the cutting surfaces 60, 61.

The combination of providing multiple cutting surfaces and the separating action provided by diverging cutting members of the cutting device 10 may be particularly effective to cut and separate an item such as pizza with fewer cutting motions back and forth along the item as compared to a cutting device having a single cutting member. The use of two cutting surfaces provided by a single converging angled relationship between the cutting members without the separating action available from a second converging/diverting angled relationship between the cutting members may alone provide improvements over single cutting member devices. In some applications, the dual disk cutting device of FIGS. 1-7 may effectively cut an item such as a cooked pizza with a single pass across the item.

A passing across an item to cut may involve first pressing the first and second cutting members 16, 18 downward via a force applied by the user at the handle 12. This downward component of the force tends to penetrate the item with the first and second cutting members 16, 18 along the cutting surfaces 60, 61. The user then applies a force having a downward component and a forward or horizontal component (assuming the item to be cut rests on a horizontal surface) to move the first and second cutting members 16, 18 along the item to provide cutting of the item. The first and second cutting members 16, 18 typically rotate as the user moves the cutting device 10 across the item.

FIGS. 1-7 illustrate both of the first and second cutting members 16, 18 arranged at angles within the X and Y planes relative to the Z plane. In other examples, only one of the first and second cutting members 16, 18 is arranged at an angle within the X and Y planes relative to the Z plane. In one example, the angles $\beta_1$ and $\alpha_1$ are greater than zero and the angles $\beta_2$ and $\alpha_2$ equal zero. In other examples, the angle $\beta_1$ is greater than zero and the angle $\alpha_1$ is equal to zero, and the angle $\beta_2$ is equal to zero and the angle $\alpha_2$ is greater than zero, so some other combination of angles that includes at least one zero value for one of the angles $\beta_1$, $\beta_2$, $\alpha_1$, $\alpha_2$.

The angles $\beta_1$, $\beta_2$ and $\alpha_1$, $\alpha_2$ are typically in the range of about 0° to about 60°, and more particularly about 15° to about 45°. In one example, the combination of angles $\beta_1$ and $\beta_2$ is greater than 0° and less than about 160°, more particularly in the range of about 30° to about 90°. Similarly, the combination of angles $\alpha_1$, $\alpha_2$ is greater than 0° and less than about 160°, and more preferably in the range of about 30° to about 90°.

Figure 7:
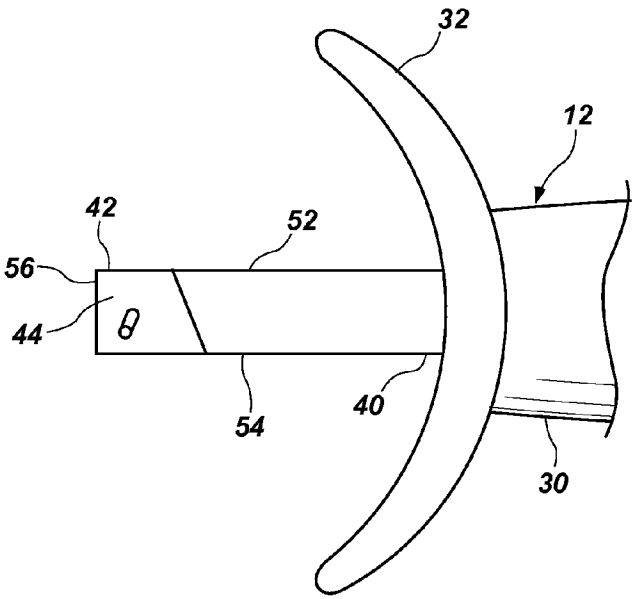
FIG. 7 is a schematic side view of the cutting member of FIG. 5.
Figure 5:
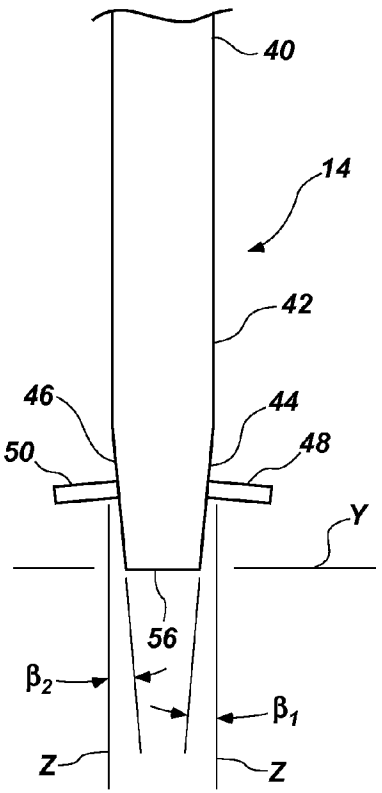
FIG. 5 is a schematic top view of an example cutting member support for use in the cutting device of FIG. 1.
Figure 6:
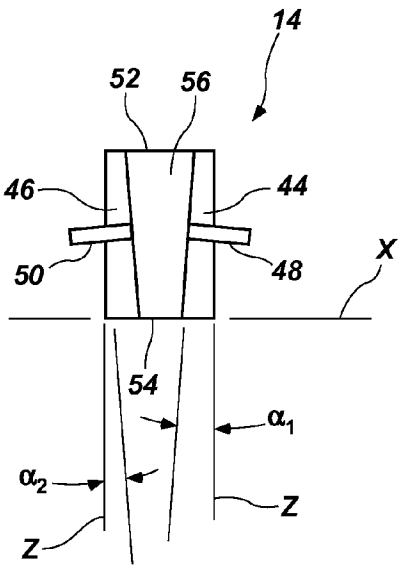
FIG. 6 is a schematic front view of the cutting member support of FIG. 5.

The angled relationship between the first and second cutting members 16, 18 shown in FIGS. 3 and 4 may be defined by the first and second mounting surfaces 44, 46 as shown in FIGS. 6 and 7. The first and second mounting surfaces 44, 46 may also be arranged at angles $\beta_1$, $\beta_2$ and $\alpha_1$, $\alpha_2$. In some arrangements, the angles $\alpha_1$, $\alpha_2$ may be defined in the cutting member support 14 along its entire length from the proximal end portion 40 to the distal end portion 42. In other arrangements, the angles $\alpha_1$, $\alpha_2$ may be defined in the first and second mounting surfaces 44, 46 only at the distal end portion 42. Typically, the angles $\beta_1$, $\beta_2$ are defined in the first and second mounting surfaces 44, 46 at the distal end portion 42.

In some arrangements, one of the first and second mounting surfaces 44, 46 may be arranged generally parallel with the Z plane (e.g., $\alpha_1$ and $\beta_1$ equal to zero) and the other of the first and second mounting surfaces 44, 46 are arranged at a non-parallel angle relative to the Z plane (i.e., at least one of $\alpha_2$ and $\beta_2$ being greater than zero).

Figure 9:
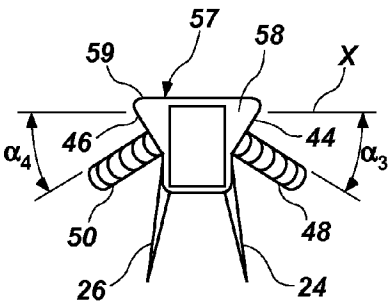
FIG. 9 is a schematic front view of the cutting member support of FIG. 8.
Figure 10:
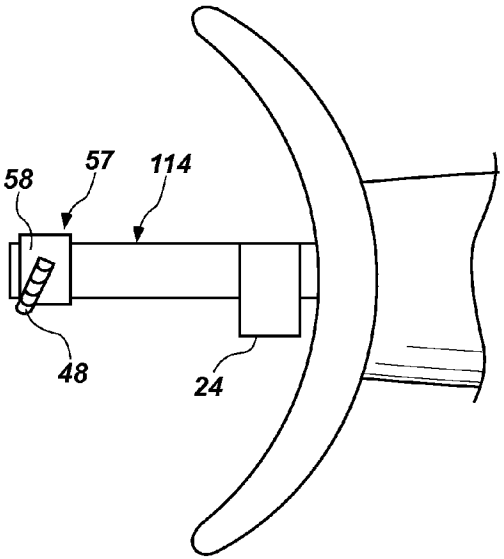
FIG. 10 is a schematic side view of the cutting member support of FIG. 8.
Figure 8:
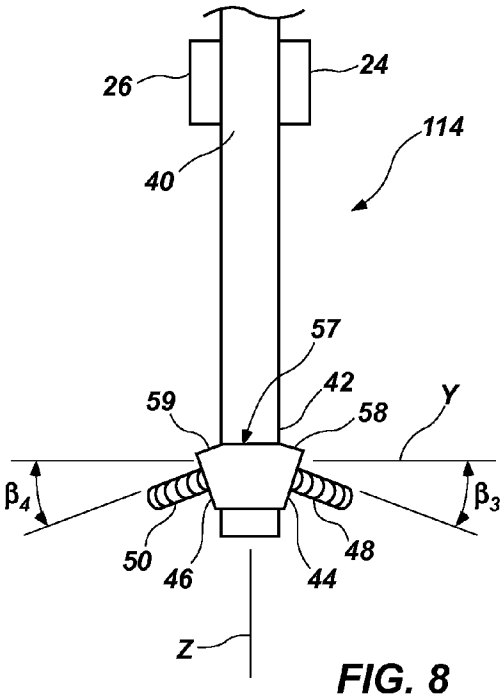
FIG. 8 is a schematic top view of another example cutting member support for use with the cutting device of FIG. 1.

The first and second mounting surfaces 44, 46 may be defined directly in the cutting member support 14. Alternatively, the first and second mounting surfaces 44, 46 may be defined in a bushing 57 that is mounted to the cutting member support 114 as shown in FIGS. 8-10. In one example, the bushing 57 may be inserted over an outer surface of the cutting member support 114 and positioned near the distal end portion 42. The bushing 57 may include first and second bushing portions 58, 59 that define the first and second mounting surfaces 44, 46.

The bushing 57 may include the first and second axle members 48, 50 mounted thereto. The first and second axle members 48, 50 may be pre-mounted to the bushing 57. The first and second axle members 48, 50 shown in FIGS. 8-9 may be arranged at angles $\beta_3$, $\beta_4$, respectively. The angles $\beta_3$, $\beta_4$ may be similar to the angles $\beta_1$, $\beta_2$ of the first and second mounting surfaces 44, 46. The first and second axle members 48, 50 may also be arranged at angles $\alpha_3$, $\alpha_4$ (see FIG. 9). The angles $\alpha_3$, $\alpha_4$ may be similar to the angles $\alpha_1$, $\alpha_2$ of the first and second mounting surfaces 44, 46. The angles $\beta_3$, $\beta_4$ and $\alpha_3$, $\alpha_4$ may be applicable to the first and second axle members 48, 50 shown with reference to FIGS. 5-7.

The cutting devices disclosed herein may include scraping members that contact one or more of the first and second cutting members 16, 18 to remove materials collected on the first and second cutting members 16, 18. FIGS. 8-10 illustrate example first and second scraping members 24, 26 that are arranged to engage inner side surfaces 67, 69, respectively, of the first and second cutting members 16, 18. The first and second scraping members 24, 26 may be mounted to the cutting member support 114. The first and second scraping members 24, 26 contact the inner side surfaces 67, 69 adjacent to the periphery 64, 65 to remove, for example, cheese or other toppings from a pizza that is being cut by the cutting device. Removal of such materials from the inner side surfaces 67, 69 may help reduce incidents of binding or clogging occurring between the first and second cutting member 16, 18 that would limit rotatability of the first and second cutting member 16, 18. Any food or other materials retained on the inner side surfaces 67, 69 may limit how close together the cutting surfaces 60, 61 may be positioned.

Figure 11:
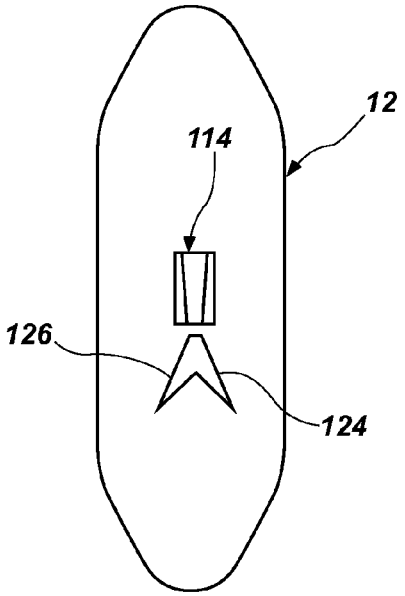
FIG. 11 is a schematic front view of another example cutting device according to principles of the present disclosure.
Figure 12:
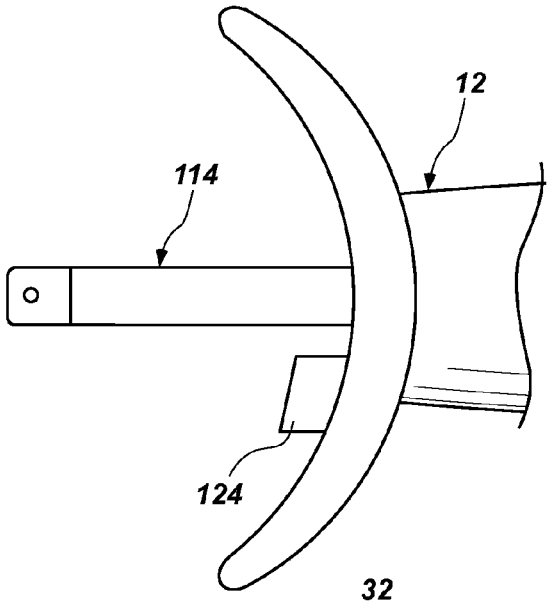
FIG. 12 is a schematic side view of the cutting device of FIG. 11.

Referring to FIGS. 11-12, another example scraping device having first and second scraping members 124, 126 is shown. The first and second scraping members 124, 126 are mounted to the handle 12. In one example, the first and second scraping members 124, 126 are mounted to the flange portion 32 of the handle 12. The first and second scraping members 124, 126 may be arranged to contact at least one of the inner side surfaces 67, 69 of the first and second cutting members 16, 18 to remove material collected thereon. The scraping members shown with reference to FIGS. 8-12 may be positioned at other locations on the cutting device 10 such as, for example, other locations along the flange portion 32 and other locations along the cutting member support 14 (e.g., at the distal end portion 42). Scraping members arranged to engage the inner side surfaces 67, 69 may be mounted separately to the cutting device as separate and individual pieces (e.g., see the first and second scraping members 24, 26). Alternatively, the first and second scraping members 24, 26 may be combined as a single unitary piece (e.g., see the first and second scraping members 124, 126).

The example cutting devices discussed above with reference to FIGS. 1-12 include a single pair of disk-shaped cutting members that are arranged side-by-side. The disk-shaped cutting members may have substantially the same shape and size. The first and second disk-shaped cutting members are each arranged at a compound angle within the X and Y planes relative to the Z plane as described above. Many alternatives to the arrangements shown with reference to FIGS. 1-12 are contemplated. In one alternative arrangement, only one of the disks is arranged at least one non-parallel angle relative to the Z plane while the other of the disks is arranged parallel to the Z plane. In another example, the disks may have different sizes or shapes. In other examples, the cutting members may have non-circular disk shapes. In some arrangements, the cutting members may rotate independently, while in other arrangements the cutting members may rotate in tandem.

The examples of FIGS. 1-12 include sets of cutting members that have relatively smooth and straight cutting surfaces. Alternative cutting members may have contoured, serrated, or other shaped cutting surfaces around its periphery. In still further arrangements, three or more cutting members may be arranged side-by-side. Any one of the three or more cutting members may be arranged at a single converging angle relative to an adjacent cutting member, or a compound angle (i.e., two or more converging angles in separate planes) relative to an adjacent cutting member. In still further examples, the cutting device may include two or more pairs of cutting members, wherein the cutting members of a given pair are arranged side-by-side, and the pairs of cutting members are arranged spaced apart in a radial direction (i.e., in series one after the other).

In some arrangements, the cutting device may include a handle or housing member with the cutting members extending from one end of the handle or housing member (i.e., see FIGS. 1-12 for example arrangements with the cutting members positioned generally forward of the handle). Some housing members may provide for the cutting members to be substantially exposed around the periphery of at least one of the cutting members. In other examples, at least a portion of the handle encloses at least a portion of at least one of the cutting members. In some arrangements, the housing member is positioned generally vertically above the cutting member. Such generally vertically arranged housing members may remain spaced vertically from the cutting members or may at least partially enclose at least one of the cutting members. Various configurations showing at least portions of the cutting member enclosed in a portion of a housing are disclosed in U.S. Pat. Nos. 4,020,555 and 7,363,701, which patents are incorporated in their entireties by this reference.

In one arrangement, the housing member includes an ergonomic design along a surface thereof that is contacted (i.e., grasped) by the user during use. The ergonomic design may include multiple contoured surfaces that are sized and configured to match certain anatomical features of the user's hand such as the palm, fingers and thumb of the user. In one example, the housing member defines surfaces configured for contact by the user's hand that are shaped and sized substantially similar to a computer mouse, such as the device disclosed in U.S. Published Patent Application Nos. 2009/0140983 and U.S. Pat. Nos. 7,006,075, D514,106, D541,803, and D551,667, which are incorporated in their entireties by this reference.

Figure 13:
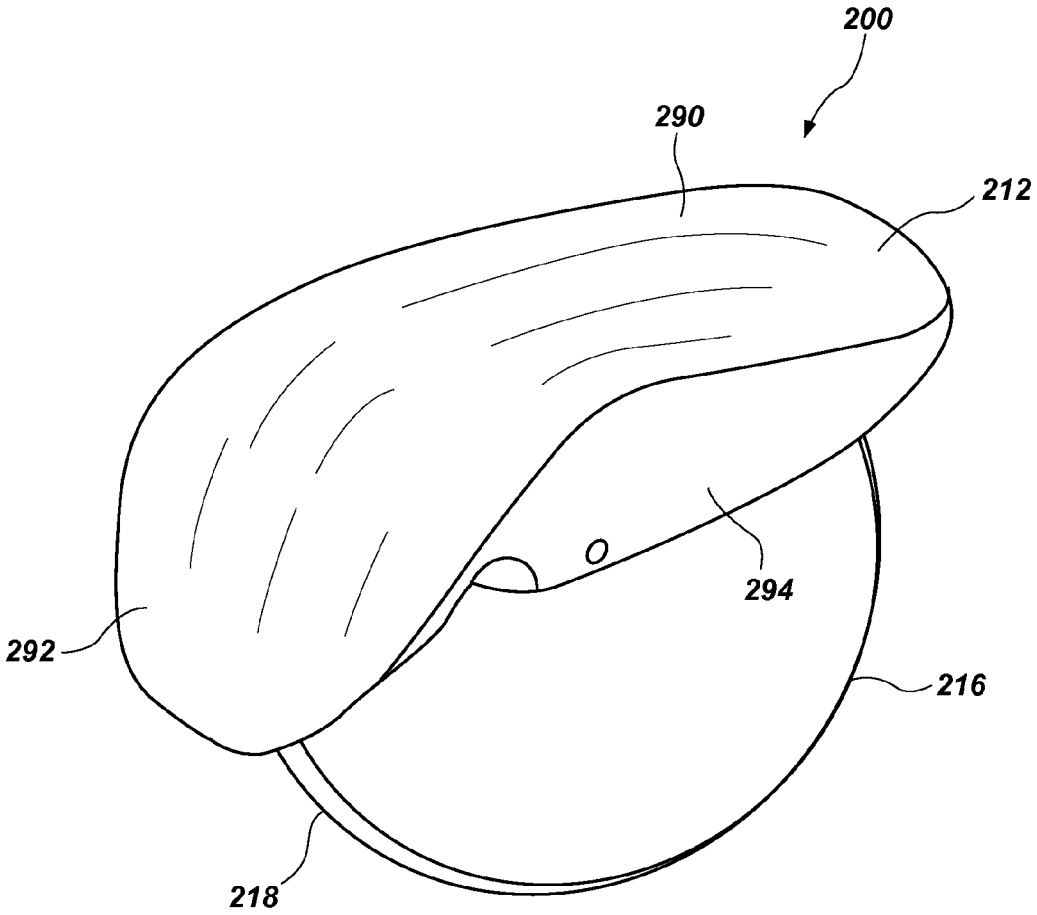
FIG. 13 is a schematic perspective view of another example cutting device according to principles of the present disclosure.

FIG. 13 illustrates another example cutting device 200 having a housing member 212 with an ergonomic design. The cutting device 200 may include first and second cutting members 216, 218. The cutting members 216, 218 may be constructed as disk shaped members similar to first and second cutting members 16, 18 described above. The cutting members 216, 218 may be arranged at a compound angle relative to each other, or an any other orientation as described above related to first and second cutting members 16, 18. In some arrangements, the cutting device 200 includes only one of the cutting members 16, 18. In other arrangements, the cutting device 200 includes three or more cutting members.

The housing member 212 may define a plurality of surfaces 290, 292, 294 that match common features of a user's hand, such as a palm, fingers, and thumb, respectively. The surfaces 290, 292, 294 may be contoured or generally planar. The surfaces 290, 292, 294 may be continuous or may be separated by other features such as edges. The housing member 212 may be constructed to enclose at least portions of at least one of the cutting members 216, 218. In other arrangements, the cutting members 216, 218 remain completely outside of the housing member 212. In some arrangements, the housing member 212 is oriented generally vertically above the cutting members 216, 218 during operation of the cutting device 200. In other arrangements, the housing member 212 is positioned at some rotated angle from a generally vertical position, such as at an angle of about 10 to about 45 degrees in a rearward rotated direction relative to a vertical axis.

The cutting members 216, 218 may be directly mounted to the housing member 212 without an intervening cutting member support (i.e., cutting member support 14 described above). Surfaces of the housing member 212 may define at least in part an angled mounted surface that defines an orientation of at least one of the cutting members 216, 218 mounted to the housing member 212.

In some arrangements, the cutting device is configured having a housing that encloses at least a portion of the cutting members and the housing defines the handle portion that the user grasps when using the cutting device. The housing may include at least one recess configured to receive or enclose a portion of at least one of the cutting members. The recess may define at least one mounting surface that defines at least in part an orientation of at least one of the cutting members relative to the housing. In one example, the recess defines first and second mounting surfaces that are arranged at non-parallel angles relative to each other. The first and second mounting surfaces define at least in part an orientation of first and second cutting members relative to each other and relative to the housing. In some arrangements, the housing may include a separate recess for each cutting member mounted to the cutting device.

The cutting members disclosed herein may comprise various materials. In one example, the first and second cutting members 16, 18 comprise a stainless steel material. In other examples, first and second cutting members 16, 18 comprise a high-strength polymer material such as polycarbonate or isoplast.

The cutting members disclosed herein, in particular the first and second disk-shaped cutting members 16, 18 described with reference to FIGS. 1-13, may have a preferred range of sizes for a given cutting application. In one example food cutting application, the first and second cutting members 16, 18 have a maximum diameter in the range of about 1 to about 6 inches, and more preferably in the range of about 3 to about 4 inches.

In some examples, the cutting device may include text, graphics, or other indicia, such as embossed or engraved writings that are included on one or more surfaces thereof. In at least one example, portions of the handle or side surfaces of the cutting members may include text or graphics.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. A cutting device, comprising:

a handle portion;

a support member extending from the handle portion;

first and second cutting members mounted to the support member, the first cutting member defining a first cutting surface and the second cutting member defining a second cutting surface, a first portion of the first cutting surface being arranged adjacent to a first portion of the second cutting surface so that the first portions of the first and second cutting surfaces effectively act as a single point of cutting, and a second portion of the first cutting surface being arranged spaced apart from a second portion of the second cutting surface;

wherein at least one of the first and second cutting members is arranged at a first non-perpendicular angle relative to a first plane in a first direction, and at a second non-perpendicular angle relative to the first plane in a second direction, the first and second directions being perpendicular to each other.

2. The cutting device of claim 1, wherein the first and second cutting members are disk shaped members, wherein outer periphery edges of the first and second cutting members define the first and second cutting surfaces.

3. The cutting device of claim 2, wherein the first and second cutting members are arranged non-parallel relative to each other.

4. The cutting device of claim 1, wherein the support member defines first and second mounting surfaces that support the first and second cutting members, respectively, wherein the first and second mounting surfaces are arranged non-parallel relative to each other.

5. A cutting device, comprising:

a first disk shaped cutting member defining a first cutting surface around a periphery thereof;

a second disk shaped cutting member defining a second cutting surface around a periphery thereof;

wherein the first and second disk shaped cutting members are arranged at a compound angle relative to each other with a first portion of the first cutting surface being positioned adjacent to a first portion of the second cutting surface, and a second portion of the first cutting surface being positioned spaced apart from a second portion of the second cutting surface, the first portions of the first and second cutting surfaces effectively acting as a single point of cutting.

6. The cutting device of claim 5, wherein the compound angle include a first angle relative to a first plane and a second angle relative to a second plane, wherein the first and second planes are arranged perpendicular to each other.

7. The cutting device of claim 5, wherein a first portion of the first cutting surface is arranged adjacent to a first portion of the second cutting surface, and a second portion of the first cutting surface is arranged spaced apart from a second portion of the second cutting surface.

8. The cutting device of claim 5, further comprising a handle and a support member extending from the handle, wherein the first and second disk shaped cutting members are mounted to the support member.

9. The cutting device of claim 8, wherein the support member includes first and second mounting surfaces configured to support the first and second disk shaped cutting members, respectively, wherein at least one of the first and second mounting surfaces defines the compound angle.

10. The cutting device of claim 9, further comprising first and second axle portions about which the first and second disk shaped cutting members rotate, respectively, wherein the first and second axle portions extend perpendicularly from the first and second mounting surfaces, respectively.

11. The cutting device of claim 5, further comprising first and second axles about which the first and second disk shaped cutting members rotate, wherein the first and second axles are arranged at the compound angle relative to each other.

12. A pizza cutter, comprising:

a handle configured for grasping by a user;

a cutting member support extending from the handle;

a first disk member supported on the cutting member support;

a second disk member supported on the cutting member support;

wherein the first and second disk members are arranged non-parallel relative to each other, and the first and second disk members are arranged at a first angle relative to a first plane in a first direction, and a second angle relative to the first plane in a second direction, the first and second directions being arranged perpendicular to each other;

wherein the first and second disk members converge together to form a single cut through a pizza.

13. The pizza cutter of claim 12, wherein the cutting member support includes first and second axle members about which the first and second disk members rotate, respectively.

14. The pizza cutter of claim 12, further comprising a scraping member, the scraping member arranged to contact a side surface of at least one of the first and second disk members.

* * * * *